United States Patent [19]

Becker et al.

[11] Patent Number: 5,048,362

[45] Date of Patent: Sep. 17, 1991

[54] DEVICE FOR TENSIONALLY CONNECTING A FIXED GEARWHEEL AND AN ADJUSTABLE GEARWHEEL ON A CYLINDER OF A TURNING APPARATUS IN A SHEET-FED ROTARY PRINTING PRESS AND, MORE PARTICULARLY, TO SUCH A DEVICE WHICH IS ELECTRICALLY SAFEGUARDED

[75] Inventors: Willi Becker, Bammental; Hans-Peter Hiltwein, Philippsburg, both of Fed. Rep. of Germany

[73] Assignee: Heidelberger Druckmaschinen AG, Fed. Rep. of Germany

[21] Appl. No.: 365,596

[22] Filed: Jun. 13, 1989

[30] Foreign Application Priority Data

Jun. 13, 1988 [DE] Fed. Rep. of Germany ..... 3820026

[51] Int. Cl.[5] ..... B41F 21/10; B41F 13/00

[52] U.S. Cl. ..... 74/439; 74/444; 101/248; 192/30 W

[58] Field of Search ..... 74/439, 440, 444, 445; 101/229, 230, 248; 192/30 W, 70.11, 95

[56] References Cited

U.S. PATENT DOCUMENTS

| | | | |
|---|---|---|---|
| 2,185,714 | 1/1940 | Scherer | 192/95 |
| 3,331,482 | 7/1967 | Keramas | 192/95 |
| 4,340,133 | 7/1982 | Blersch | 192/30 W |
| 4,457,231 | 7/1984 | Kawaguchi | 101/248 |
| 4,735,140 | 4/1988 | Wieland et al. | 101/248 |
| 4,782,717 | 11/1988 | Becker | 74/439 |
| 4,787,261 | 11/1988 | Becker | 74/439 |
| 4,836,112 | 6/1989 | Moore | 101/248 |
| 4,848,531 | 7/1989 | Gray et al. | 192/30 W |

FOREIGN PATENT DOCUMENTS

| | | | |
|---|---|---|---|
| 2901236 | 10/1979 | Fed. Rep. of Germany . | |
| 3414957 | 10/1984 | Fed. Rep. of Germany . | |
| 3611325 | 10/1987 | Fed. Rep. of Germany . | |
| 814318 | 6/1937 | France | 192/70.11 |
| 817354 | 7/1959 | United Kingdom . | |
| 1253525 | 11/1971 | United Kingdom . | |
| 1370011 | 10/1974 | United Kingdom | 192/30 W |

OTHER PUBLICATIONS

Japan Application 56-176512 (Komori-Insatsu-Kikai) May 12, 1983.

*Primary Examiner*—Leslie A. Braun
*Assistant Examiner*—Scott Anchell

[57] ABSTRACT

In a sheet-fed rotary printing press, a device for tensionally connecting a fixed gearwheel and a gearwheel coaxial with and adjustable in rotational position thereof relative to the fixed gearwheel on a cylinder of a turning device in the printing press, comprising an actuatable clamping element and a clamping body for clamping the fixed gearwheel and the adjustable gearwheel together, the clamping body being braced against one of the gearwheels, and being held with the clamping element on the other of the gearwheels, friction elements carried by the gearwheels so as to be mutually overlappingly interengaging in the manner of a multi-drive clutch, the clamping body having an annular bearing by which the clamping body is braced against an outer one of the friction elements in an overlap region of the friction elements.

17 Claims, 4 Drawing Sheets

DEVICE FOR TENSIONALLY CONNECTING A FIXED GEARWHEEL AND AN ADJUSTABLE GEARWHEEL ON A CYLINDER OF A TURNING APPARATUS IN A SHEET-FED ROTARY PRINTING PRESS AND, MORE PARTICULARLY, TO SUCH A DEVICE WHICH IS ELECTRICALLY SAFEGUARDED

The invention relates to a device for tensionally or force-lockingly i.e. by friction, connecting a fixed gearwheel and an adjustable gearwheel, the adjustable gearwheel being adjustable in rotational position thereof with respect to the fixed gearwheel on a cylinder of a turning device in a sheet-fed rotary printing press. The invention relates further to electrical means for safeguarding such a device in order to prevent a printing press from being put into operation when it is not ready for operation.

A device for form-lockingly or frictionally connecting a fixed gearwheel and an adjustable gearwheel for adjusting the rotational positions of both gearwheels has become known heretofore from German Published Non-Prosecuted Application (DE-OS) 36 11 325. In this known device, the edge of a clamping disc acts as an abutting counterbearing for pressure levers which are distributed about the circumference and which, with one end thereof, press the adjustable gearwheel against a recess of an annular shoulder in the fixed gearwheel and, with the other inwardly directed end thereof, being subjected to the spring force of a centrally disposed clamping element, the abutting counterbearing, in order to achieve an optimal lever action, having been shifted far to the outside, so that as high a torque as possible can be absorbed by the force-locking connection which is effected by the friction of the contacting surfaces of the two gearwheels. High torques correspondingly require very high clamping forces.

In the heretofore known device of the German publication, for electrically safeguarding the clamp-type connection, the actuating element is adjustable by means of a screw thread over a path which includes a first section, in which the spring force acting on the pressure levers increases from a low value to a value necessary for maintaining the relative rotational position, and includes a second section, in which the spring force necessary for maintaining the relative rotational position is maintained, so that the rotary printing press can be put into operation only if there is a sufficiently rigid connection between the fixed gearwheel and the adjustable gearwheel. The instant the actuating element is moved out of its end position in order to release the adjustable gearwheel, there is initially an interruption in the power supply circuit of the driving device and only then is there a reduction in the connection or coupling forces.

A comparable connection is known from Japanese Patent 58-78763, in which, for the purpose of connection, the adjustable gearwheel is pressed likewise into a recess of an annular shoulder of the fixed gearwheel. Four clamping elements are provided for this purpose and distributed over the circumference, each of which is tensioned by a threaded tension bolt and, for turning or tightening a female thread for these tension bolts, a transmission unit formed of two coaxial worms and four worm wheels are provided, the toothing of which engages pairwise from opposite sides in the toothing of both worms. Both worms are rotatable by a common crank through the intermediary of a bevel-gear transmission. Such a device is relatively expensive and impractical to use. The worm-gear transmission requires several revolutions of the crank, among other things also for actuating the phase displacement of the adjustable gearwheel with respect to the fixed gearwheel. Moreover there is no electrical safeguarding of the connection when in the operating position.

It is accordingly an object of the invention to provide a device of the foregoing general type which can be safeguarded, if necessary or desirable, electrically, when in the operating position, the device having the aforementioned features, so that, with low-cost or economical construction, higher torques can be transmitted with lower clamping forces than heretofore, this being rendered possible preferably with only one clamping screw.

With the foregoing and other objects in view, there is provided in accordance with the invention in a sheet-fed rotary printing press, a device for tensionally connecting a fixed gearwheel and a gearwheel coaxial with and adjustable in rotational position thereof relative to the fixed gearwheel on a cylinder of a turning device in the printing press, comprising an actuatable clamping element and a clamping body for clamping the fixed gearwheel and the adjustable gearwheel together, the clamping body being braced against one of the gearwheels, and being held with the clamping element on the other of the gearwheels, friction elements carried by the gearwheels sc as to be mutually overlappingly interengaging in the manner of a multidrive clutch, the clamping body having an annular bearing by which the clamping body is braced against an outer one of the friction elements in an overlap region of the friction elements.

In accordance with another feature of the invention, the friction elements are friction discs extending radially inwardly from one of the gearwheels and radially outwardly from the other of the gearwheels, and being fastened alternatingly to the gearwheels.

An essential feature of this construction is the increase in the frictional force by increasing the number of effective friction surfaces. This is accomplished preferably by the friction elements in the form of friction discs on the fixed gearwheel and on the adjustable gearwheel, the friction discs interengaging alternatingly in the manner of a multi-disc clutch, and resulting overall in a considerable increase in the frictional force. Assuming a constant coefficient of friction, it is thus possible to reduce the clamping force for the tensioning or frictional connection between the fixed gearwheel and the adjustable gearwheel. Conversely, given a constant clamping force, this constructions permits a considerable increase in the torque transmissible by the connection, which results in considerable advantages with regard to safe operation, especially in the case of high-speed printing presses. The fact that the clamping body is braced with an annular bearing against an outer friction disc in the overlap region of the friction discs means that the clamping device may be formed of a single, centrally disposed clamping element, such as a threaded bolt with an external bolt head, particularly, the thread of which can be screwed into a female thread located centrally in the shaft of the cylinder of the turning device.

In accordance with again another feature of the invention the clamping body is formed of a clamping plate which is both held on the fixed gearwheel and braced by the annular bearing thereof against the outer friction disc, the outer friction disc being fastened to the fixed gearwheel and forming part of a friction-disc packet having a plurality of friction discs, the friction discs of the packet being spaced apart so as to receive therebetween at an edge thereof at least one friction disc fastened to the adjustable gearwheel, the friction-disc packet including a friction disc in contact with an annular surface of the adjustable gearwheel at an opposite side thereof from the outer friction disc.

In accordance with another feature of the invention, the clamping element is a clamping screw actuatable from the outside, the clamping screw extending through a central bore formed in the clamping body and being threadedly securable into a corresponding female thread fixed in position with respect to the fixed gearwheel.

In accordance with a further feature of the invention, at least one of the gearwheels has a plurality of the friction discs with intermediate rings disposed therebetween, the intermediate rings having a thickness corresponding to the thickness of a friction disc of the other of the gearwheels.

In accordance with an added feature of the invention, the friction discs are elastically deformable in axial direction of the gearwheels.

In accordance with an additional feature of the invention, the friction elements are friction discs, including at least one radially outer friction disc fastened to the adjustable gearwheel, and a plurality of radially inner friction discs fastened to the fixed gearwheel, the inner and outer friction discs mutually overlappingly interengaging, the outer friction disc being of split construction and assemblable in segments.

In accordance with yet another feature of the invention, the outer and inner friction discs are formed with incisions in the overlap region, the incisions defining lugs therebetween.

In accordance with yet a further feature of the invention, the friction discs and the intermediate rings disposed therebetween are positively connected to the respective gearwheels.

In accordance with yet an added feature of the invention, the friction discs and the intermediate rings disposed therebetween are connected by tension to the respective gearwheels.

In accordance with yet an additional feature of the invention, the friction discs and the intermediate rings disposed therebetween have an intermediate layer, in turn, therebetween for bonding them to one another.

The one clamping screw or bolt affords advantageous conditions for the arrangement of electrical means for safeguarding the effective connection of the gearwheels.

In accordance with still another feature of the invention, there are provided electrical means for safeguarding an effective connection of the fixed gearwheel to the adjustable gearwheel, a switching ring fastened to the clamping element, and at least one radially movably guided switching plate provided on the clamping body, the switching plate being movable radially by the switching ring when the connection between the gearwheels is released and being engageable by an arcuate contact surface thereon with an electric switch in a power-supply circuit of the printing press for actuating the electric switch.

In accordance with still a further feature of the invention, the switching ring and the switching plate have respective complementary cam dogs and cam curves for effecting cooperative engagement.

In accordance with still an added feature of the invention, the switching plate is formed of four quarter-circular segments disposed opposite one another diametrically to the axis of the clamping element and cooperating pairwise for moving inwardly and outwardly, respectively, in the same direction.

The construction ensures as large a rotational angle as possible for the threaded bolt, in particular, a rotational angle of almost 180°, for releasing the friction-type or force-locking connection between the two gearwheels.

In accordance with still an additional feature of the invention, the cam dogs are disposed on the switching plate, and the complementary cam curves are disposed in grooves formed in the switching ring, respective complementary cam dogs and cam curves of one pair of the segments being offset axially and radially by 90° from the cam dogs and cam curves of the other pair of the segments.

In accordance with again another feature of the invention, the cam dogs of the one pairs of segments of the switching plate are disposed on a front side thereof, and the cam dogs of the other pair of segments are disposed on a rear side of the switching plate.

In accordance with a concomitant feature of the invention, there are provided spring means for biasing the segments of the switching plate against a radial movement for actuating the electric switch in the power-supply circuit of the printing press.

Other features which are considered as characteristic for the invention are set forth in the appended claims.

Although the invention is illustrated and described herein as embodied in a device for tensionally connecting a fixed gearwheel and an adjustable gearwheel on a cylinder of a turning apparatus in a sheet-fed rotary printing press and, more particularly, to such a device which is elastically safeguarded, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 4:
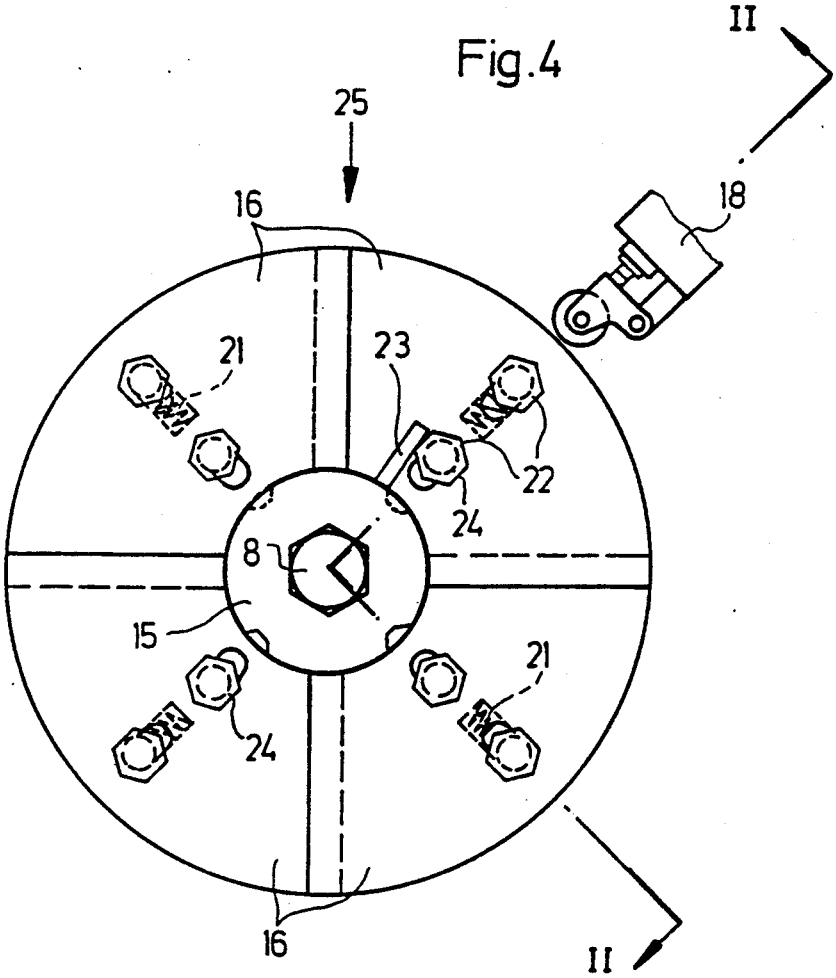
FIG. 4 is a front elevational view of the components of an electrical safety device forming part of the embodiment of FIG. 2, in operating position thereof.
Figure 4A:
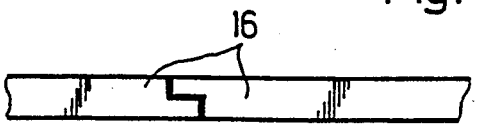
Figure 5:
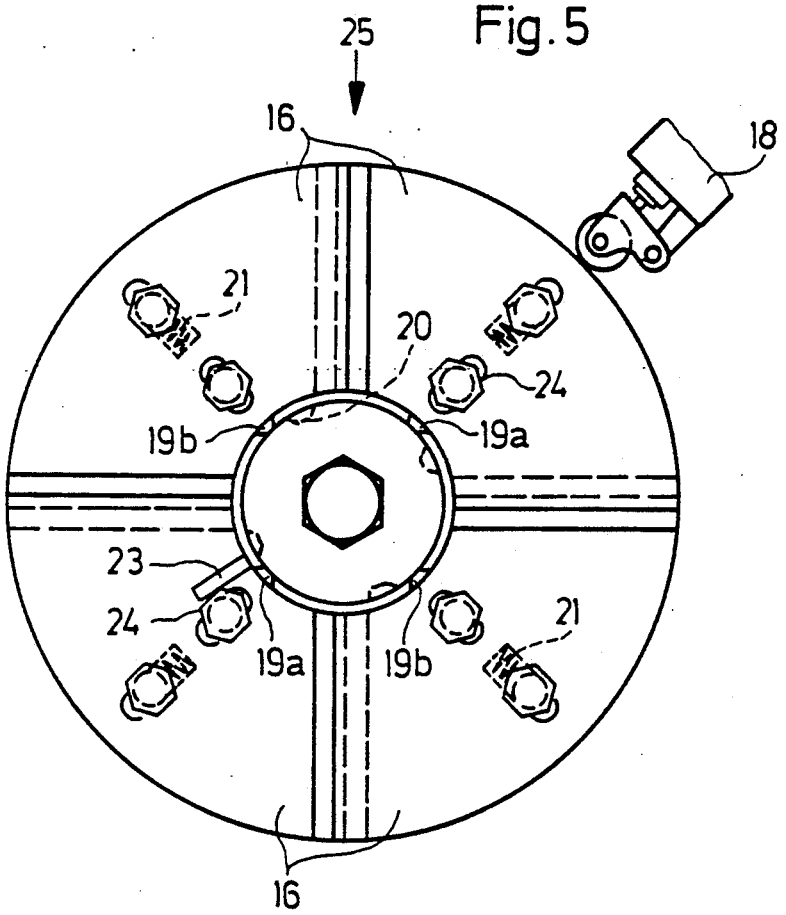
Figure 5A:
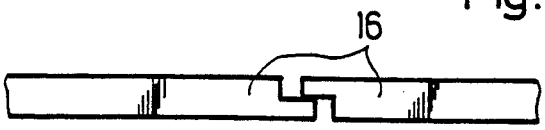

FIG. 4*a* is a fragmentary top plan view of FIG. 4 in the direction of the arrow 25;

FIG. 5 is a view similar to that of FIG. 4, but in a phase wherein the clamp-type connection is released; and FIG. 5*a* is a fragmentary top plan view of FIG. 5 in the direction of arrow 25.

Figure 2:
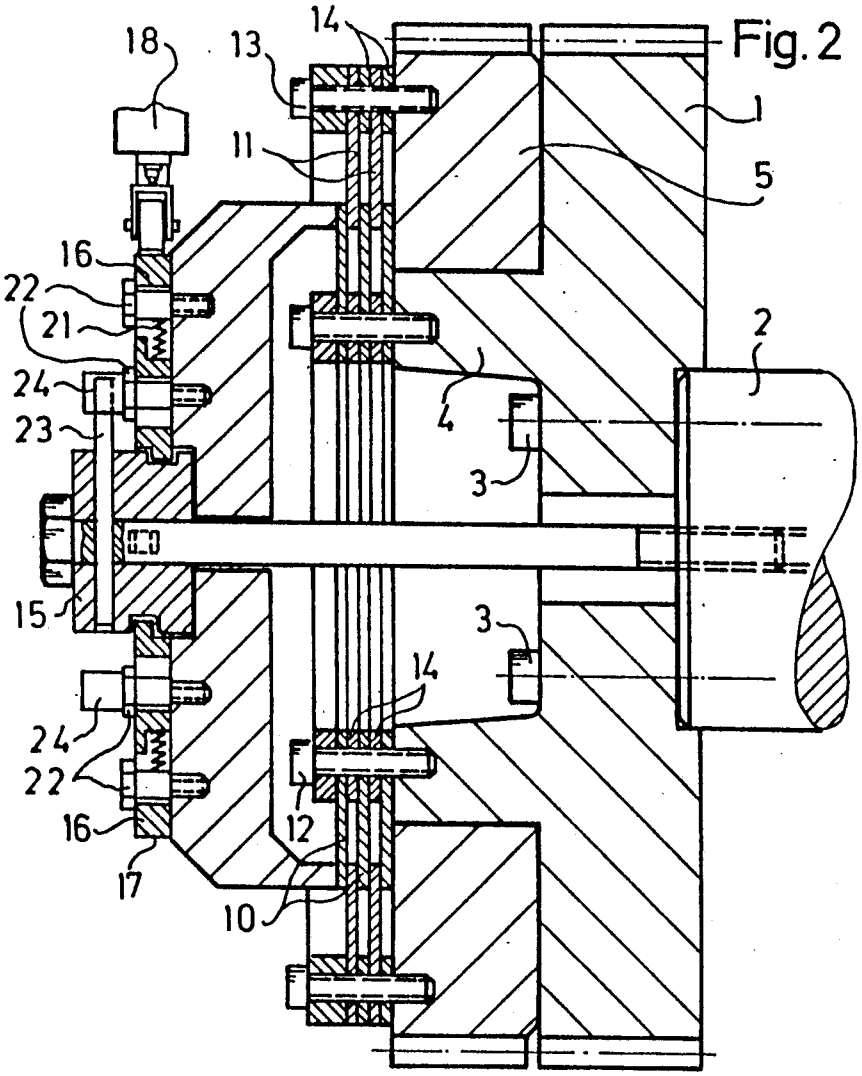
FIG 2 is a view like that of FIG. 1 of a second embodiment of the invention taken along a section line II—II in FIG. 4.
Figure 1:
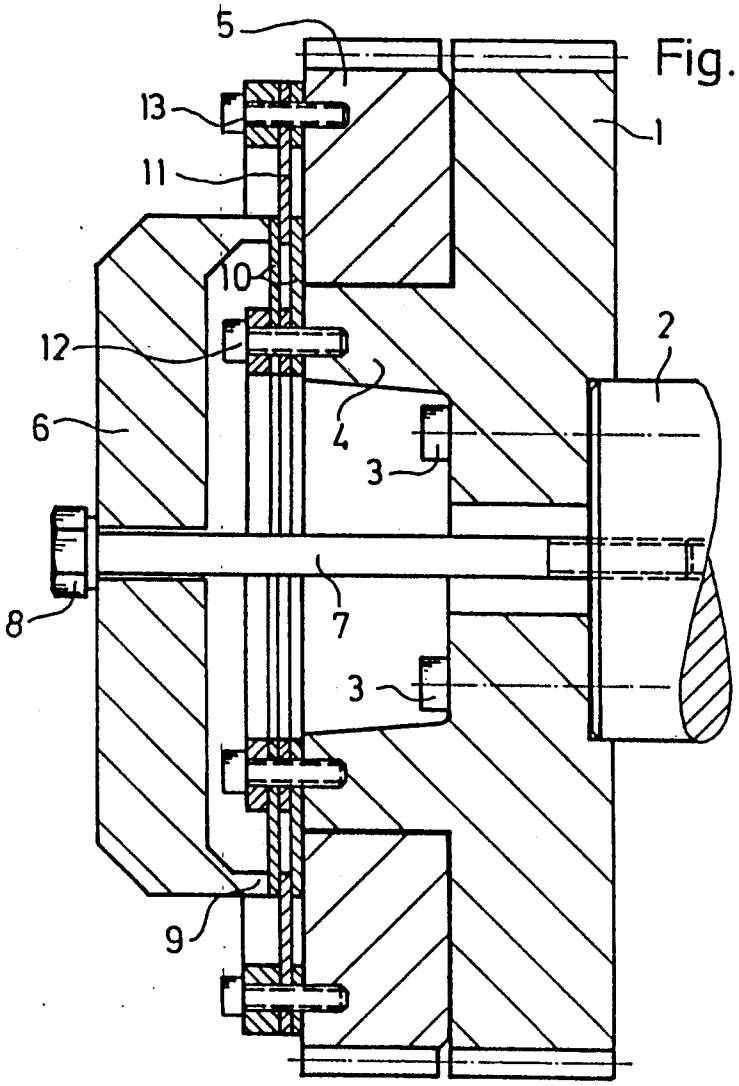
FIG. 1 is a cross-sectional view taken along an axial plane of a first embodiment of a clamp-type connection according to the invention on a cylinder of a turning device.

Referring now to the drawing and, first, particularly to FIGS. 1 and 2 thereof, there are shown two embodiments of a clamp type connection according to the invention wherein a fixed gearwheel 1 is shown mounted on one end of a shaft 2 of a cylinder (not shown in the drawing in the interest of clarity) of a turning device of a sheet-fed rotary printing press convertible for effecting first form printing or first form and perfector printing. The fixed gearwheel 1 is bolted, coaxially with the shaft 2, to an end face of the shaft 2 by bolts 3. On the front side of the fixed gearwheel 1, a plug extension or shoulder 4 is formed in an angular recess as viewed in FIGS. 1 and 2, and a crown-like gearwheel 5 adjustable in the rotational angle thereof, is mounted on the plug extension 4 and is couplable by clamping with the fixed gearwheel 1. This force-locking or friction-type connection of the adjustable gearwheel 5 to the fixed gearwheel 1 is effected by a clamping plate 6, which forms a clamp body, and by a clamping element such as a bolt or screw 7, which passes through a central bore formed in the clamping plate 6, and is braced by a bolthead 8 against the clamping plate 6, the bolt 7 being threadedly securable by its male thread in a female thread formed in a bore in the shaft 2.

An integrally formed pressure ring 9 is disposed at the inside of the clamping plate 6 and presses the adjustable gearwheel 5 against the fixed gearwheel 1 during the tightening of the clamping screw 7, with the result that both gearwheels 1 and 5 are force-lockingly i.e. nonpositively, connected to one another by friction. This is effected by the end-face contact surfaces of both gearwheels 1 and 5.

In order to increase the effective friction surfaces between the fixed gearwheel 1 and the adjustable gearwheel 5, additional friction elements 10 and 11 are provided and are connected alternatingly to one of the two gearwheels 1, 5, with the friction elements overlappingly interlocking in the manner of a multi-disc clutch and being likewise firmly pressed together in an overlap region by the clamping plate 6 through the intermediary of the pressure ring 9, which is braced against an external one of the friction elements 10. The friction elements 10 and 11 are formed of friction discs or plates which are fastened either to the fixed gearwheel 1 or to the adjustable gearwheel 5, respectively, by means of bolts 12 and 13 and interengage like a multi-disc clutch or brake, with the result that an overlap region is formed behind the pressure ring 9. The embodiment shown in FIG. 1 exhibits two friction discs or plates 10, which are fastened by bolts 12 to an end face of the plug extension or shoulder 4, and another friction disc or plate 11, which is fastened by bolts 13 to a lateral face of the adjustable gearwheel 5. The differences in height caused by the thicknesses of the material in the axial direction of the shaft 2 are compensated for by washers, intermediate rings 14 or other elements. The inner edge of the friction disc or plate engages between the outer edges of the friction discs 10 like clutch discs, so that thereby three additional, annular friction surfaces are formed through which the transmissible frictional forces can be increased. A further increase in the number of frictional surfaces can be achieved, for example, by a packet-like arrangement of the friction discs, as is shown by way of example in FIG. 2. As shown in FIG. 2, two friction discs 11 are fastened to the adjustable gearwheel 5 by bolts 13. The friction discs 11 have inner edges which engage between the outer edges of friction discs 10, which are fastened to the plug extension or shoulder 4 of the fixed gearwheel 1 by bolts 12. The pressure ring 9 formed on the clamping plate 6 presses against the outer friction disc 10 of the packet of friction discs, which is attached to the plug extension or shoulder 4, the inner friction disc of the packet of friction discs being braced against an annular bearing surface on the adjustable gearwheel 5, with the result that five additional friction surfaces are formed.

Figure 3:
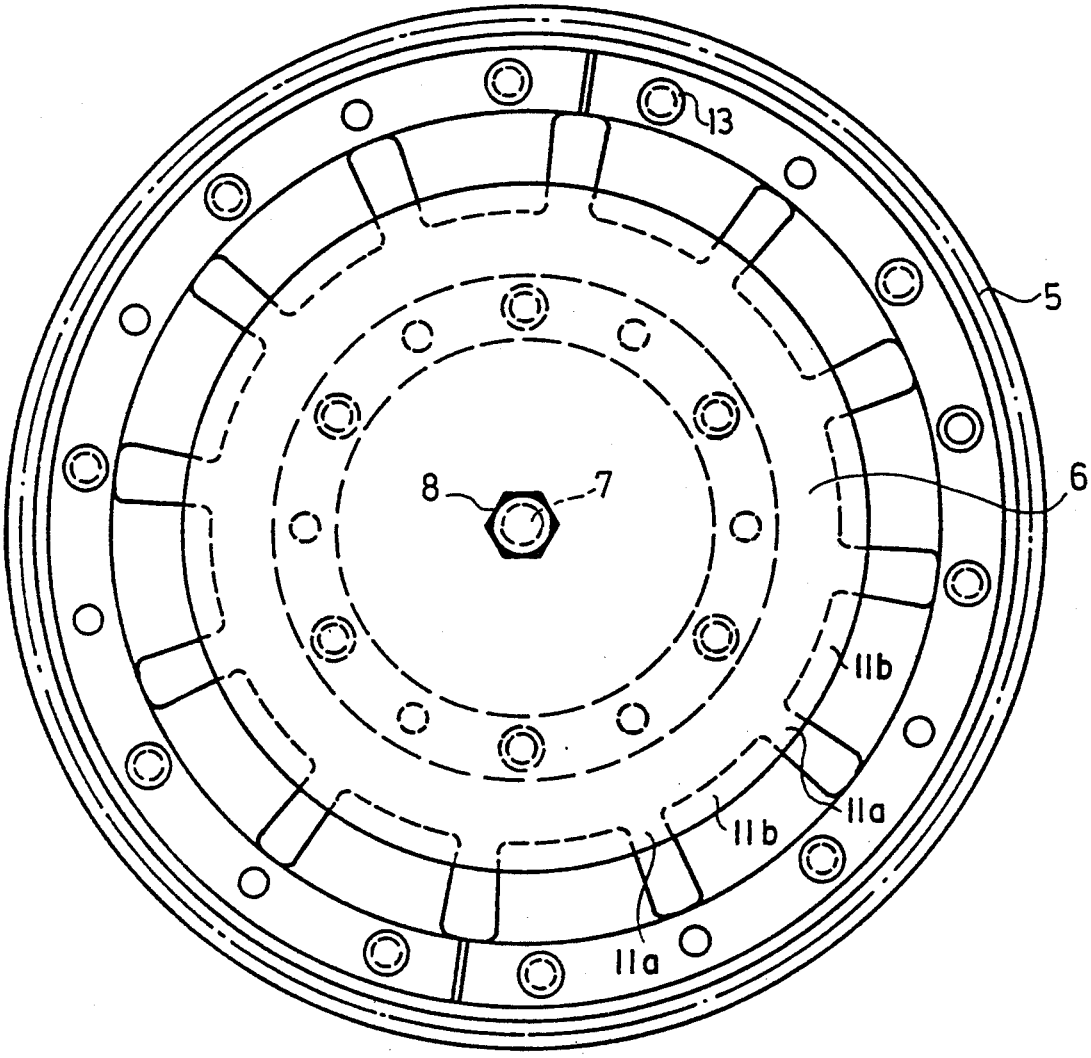
FIG. 3 is a front elevational view of FIG. 1.

The friction discs or plates 10 and 11 are elastically deformable in the direction of the axis of the shaft 2 in the construction illustrated in FIGS. 1 and 2 and, as much as possible, offers no resistance to the clamping forces exerted by the pressure ring 9. This is achieved by an elastically deformable material and, if necessary or desirable, may be further enhanced by providing the friction discs, in the overlap region and, if necessary, beyond it, with radial incisions and cutouts **11*a*, respectively, forming lugs 11*b* which can be deformed in the axial direction of the shaft 2 more easily, as can be seen, for example, in FIG. 3. For the purpose of assembly, at least those friction discs which are fastened to the adjustable gearwheel 5 or to the fixed gearwheel 1 are of split or divided construction, so that segments which can be installed separately are provided. Advantageously, the friction discs 11 fastened to the adjustable gearwheel 5 are composed of segments which are pushed from outside between the friction discs 10** after the latter have already been permanently installed.

Instead of the positive form-fit or form-locking connection of the friction discs which are attached to the same gearwheel as shown in the figures, it is also possible to provide a non-positive friction-type or force-locking connection. The assembly and disassembly of the friction discs may be facilitated by joining the friction discs and intermediate rings together with intermediate layers to form packets, e.g. by bonding them together, so that it is necessary only to assemble one part, either in the form of a ring or in the form of a ring segment, as was explained hereinabove.

Means for electrically safeguarding the effective coupling of or connection between the fixed gearwheel 1 and the adjustable gearwheel 5, are formed of a switching or control ring 15, non-rotatably fixed on the clamping screw 7, and of switching or control plates 16, which are radially movably guided on the clamping plate 6, and are moved radially by the switching ring 15 when the clamp-type connection between the fixed gearwheel 1 and the adjustable gearwheel 5 is released and which thus act with an arcuate contact surface 17 on an electrical switch 18, which is disposed in the power-supply circuit of the printing press. The switching plate 16 is made up of four quarter-circle segments, respective pairs of which are opposite one another diametrically with respect to the axis of the clamping screw 7, and cooperate pairwise so that they are moved in the same direction either jointly from inside to outside or jointly from outside to inside towards the center of the clamping screw 7. These elements of the electrical safety device are represented in FIGS. 4 and 5 of the drawing, with the clamping screw 7, however, being concealed by the screw head 8. Each segment of the switching plate 16 has a cam dogs **19*a*, 19*b* on the inner annular surface thereof, which cooperates with a complementarily shaped cam curve 20 on the switching ring 15. The cam dog and cam curve of the one segment pair of the switching plate 16 are offset both axially and radially by 90 degrees from the cam dog and cam curve of the other segment pair on the switching plate 16. As the clamping screw 7 rotates, there is also a relative movement of the switching ring 15 in relation to the segments of the switching plate 16, so that the cam dogs and cam curves 19***a*, 19*b* and 20 effect a radial movement of the segments of the switching plate, due to which the switch 18 is actuated. In order to ensure that this movement will provide an adequate travel path for a minimum angle of rotation, the effective cam surfaces are formed with a slope or inclination, which may be straight or curved. The return movement of the segments of the switching plate 16 is accomplished advantageously by spring force, so that, by means of a spring 21, each segment of the switching plate 16 is spring-loaded inwardly towards the axis of the clamping screw 7 with respect to the clamping plate 6. Guidance of the segments of the switching plate 16 is effected by means of bolts or screws 22, which pass through radially directed slits formed in the segments of the switching plate. The segmentation of the switching plate 16 and the pair-wise cooperation of the segments are achieved constructively by providing the cam dogs 19*a* of one pair of segments on the side of the segments facing towards the viewer of FIGS. 4, 4*a*, 5 and 5*a*, and the cam dogs 19*b* of the other pair of segments on the side of the segments of the switching plate facing away from the viewer of FIGS. 4, 4*a*, 5 and 5*a*. Rotation of the clamping screw through more than 90 degrees together with opening of the switch 18 in the driving circuit of the printing press thus results. The opening movement is limited by a stop pin 23 which is connected to the switching ring 15 and cooperates with stops 24 on the bolts or screws 22 for the guidance and holding of one of the pairs of segments, and limits to approximately 160 degrees the generating or aperture angle of the clamping screw 7 from one stop position to the other stop position.

It is noted that a force-locking connection is one which connects two elements together by force external to the elements, as opposed to a form-locking connection which is provided by the shapes of the elements themselves.

What is claimed is:

1. In a sheet-fed rotary printing press, a device for tensionally connected a fixed gearwheel and a gearwheel coaxial with and adjustable in rotational position thereof relative to the fixed gearwheel, comprising an actuatable clamping element and a clamping body for clamping the fixed gearwheel and the adjustable gearwheel together, said clamping element being disposed substantially centrally on said clamping body, said clamping body being braced against one of the gearwheels, and being held with said clamping element on the other of the gearwheels, friction elements carried by the gearwheels as to be mutually overlappingly interengaging in the manner of a multidrive clutch, said clamping body having an annular pressure member radially spaced from said substantially centrally disposed clamping element for bracing said clamping body against the one gearwheel through the intermediary of said friction elements in an overlap region of said friction elements.

2. Device according to claim 1, wherein said friction elements are friction discs extending radially inwardly from one of the gearwheels and radially outwardly from the other of the gearwheels, said friction elements being fastened alternatingly to the gearwheels.

3. Device according to claim 2, wherein said clamping body is formed of a clamping plate which is both held on the fixed gearwheel and braced by said annular pressure member thereof against said outer friction disc, said outer friction disc being fastened to the fixed gearwheel and forming part of a friction-disc packet having a plurality of friction discs, said friction discs of said packet being spaced apart so as to receive therebetween at an edge thereof at least one friction disc fastened to the adjustable gearwheel, said friction-disc packet including a friction disc in contact with an annular surface of the adjustable gearwheel at an opposite side thereof from said outer friction disc.

4. Device according to claim 2, wherein at least one of the gearwheels has a plurality of said friction discs with intermediate rings disposed therebetween, said intermediate rings having a thickness corresponding to the thickness of a friction disc of the other of the gearwheels.

5. Device according to claim 4, wherein said friction discs and said intermediate rings disposed therebetween are positively connected to the respective gearwheels.

6. Device according to claim 4, wherein said friction discs and said intermediate rings disposed therebetween are secured to the respective gearwheels by applied force.

7. Device according to claim 4, wherein said friction discs and said intermediate rings disposed therebetween are bonded to one another so as to be formed into respective packets.

8. Device according to claim 2, wherein said friction discs are elastically deformable in axial direction of the gearwheels.

9. Device according to claim 1, wherein said clamping element is a clamping screw actuatable from the outside, said clamping screw extending through a central bore formed in said clamping body and being threadedly securable into a corresponding female thread fixed in position with respect to the fixed gearwheel.

10. Device according to claim 1, wherein said friction elements are friction discs, including at least one radially outer friction disc fastened to the adjustable gearwheel, and a plurality of radially inner friction discs fastened to the fixed gearwheel, said inner and outer friction discs mutually overlappingly interengaging, said outer friction disc being of split construction and assemblable in segments.

11. Device according to claim 10, wherein said outer and inner friction discs are formed with incisions in said overlap region, said incisions defining lugs therebetween.

12. Device according to claim 1 including electrical means for safeguarding an effective connection of the fixed gearwheel to the adjustable gearwheel, a switching ring fastened to said clamping element, and at least one radially movably guided switching plate provided on said clamping body, said switching plate being movable radially by said switching ring when the connection between the gearwheels is released and being engageable by an arcuate contact surface thereon with an electric switch.

13. Device according to claim 12, wherein said switching ring and said switching plate have respective complementary cam dogs and cam curves for effecting cooperative engagement.

14. Device according to claim 13, wherein said switching plate is formed of four quarter-circular segments disposed opposite one another diametrically to the axis of said clamping element and cooperating for moving inwardly and outwardly, respectively, in the same direction.

15. Device according to claim 14, wherein said cam dogs are disposed on said switching plate, and said complementary cam curves are disposed in grooves formed in said switching ring, respective complementary cam dogs and cam curves of one pair of said segments being offset axially from the cam dogs and cam curves of the other pair of said segments.

16. Device according to claim 15, wherein said cam dogs of said one pairs of segments of said switching plate are disposed on one side thereof, and said cam dogs of said other pair of segments are disposed on a side of said switching plate opposite to said one side thereof.

17. Device according to claim 14, including spring means for biasing said segments of said switching plate against said radial movement for actuating the electric switch.

* * * * *